United States Patent [19]

Giannoni

[11] 3,949,494

[45] Apr. 13, 1976

[54] CHILDREN'S SHOE

[76] Inventor: Ilvio Giannoni, 156 Via XX Settembre, 06100 Perugia, Italy

[22] Filed: Mar. 27, 1974

[21] Appl. No.: 455,331

[30] Foreign Application Priority Data

Oct. 12, 1973 Italy ..... 53080/73

[52] U.S. Cl. ..... 36/2.5 F

[51] Int. Cl.[2] ..... A43B 00/00

[58] Field of Search ..... 36/2.5 R, 2.5 E, 2.5 F

[56] References Cited

UNITED STATES PATENTS

| | | | |
|---|---|---|---|
| 2,520,301 | 8/1950 | Ayers | 36/2.5 F |
| 2,554,075 | 5/1951 | Vigorith | 36/2.5 F |

FOREIGN PATENTS OR APPLICATIONS

| | | | |
|---|---|---|---|
| 1,210,529 | 3/1960 | France | 36/2.5 F |

*Primary Examiner*—Patrick D. Lawson
*Attorney, Agent, or Firm*—Cushman, Darby & Cushman

[57] ABSTRACT

A children's shoe incorporating an arch support, comprising: an upper having a base provided with a perforate front portion and an unperforate middle and rear portion, the instep side of said middle portion having a recess; a heel piece applied to the upper, the instep side of its rim following the contour of said recess; a cover strip applied by its top margin to the unperforate portion of said base, part of said top margin forming a curve complementary to said recessed base and being fastened to it; an insole having a perforate front portion fastened to the front portion of said upper and an unperforate front portion fastened to said unperforate base portion; an arch support fastened to the middle and rear insole portion, said arch support having its raised part fastened to the instep portion of said insole and a peripheral groove registering with the remaining imperforate base of the upper; a sole applied over said front portion of the insole and over the arch support.

1 Claim, 8 Drawing Figures

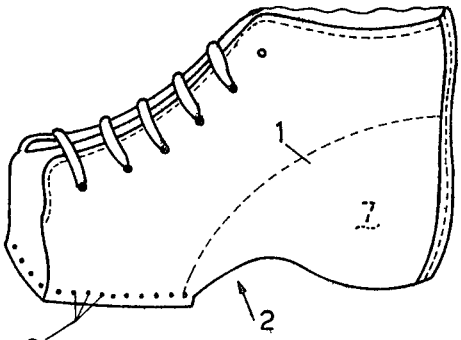
Fig. 1
Fig. 3
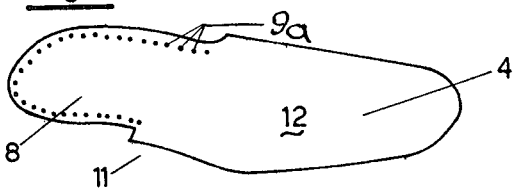
Fig. 2
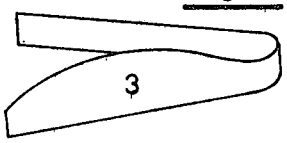
Fig. 4
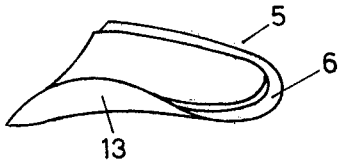
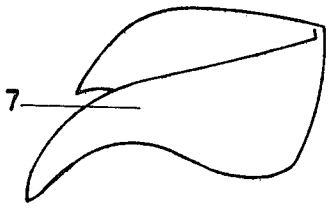
Fig. 5
Fig. 6
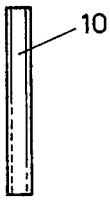
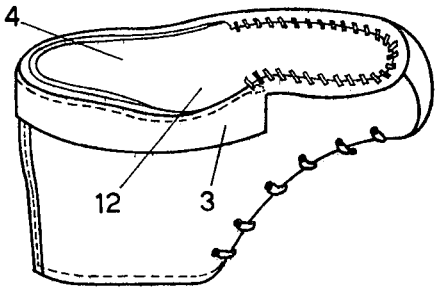
Fig. 7
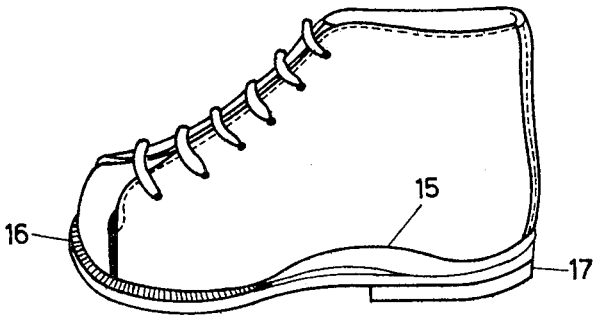
Fig. 8

CHILDREN'S SHOE

The invention refers to a children's shoe incorporating an arch support and to a procedure for its manufacture.

The shoe of the invention has excellent corrective characteristics for children's feet and is extremely simple and unexpensive to manufacture.

The shoe of the invention and its components as well as their manner of assembly will be illustrated in the following with reference to the attached schematic drawings, wherein:

FIG. 1 is a lateral view of the instep side of the upper of a right shoe;

FIG. 2 is a lateral view of the covering strip of the shoe;

FIG. 3 is a view of the insole;

FIG. 4 is a view of the arch support which is to be incorporated into the shoe;

FIG. 5 is a view of the heel piece of the shoe;

FIG. 6 is a view of the backstay of said shoe;

FIG. 7 shows how the upper is assembled with the insole and the cover strip over a last;

FIG. 8 shows the completed right shoe viewed from the instep side.

The shoe comprises an upper 1, which, as shown in FIG. 1, is already completed with the backstay 10 attached to it.

The front portion of the lower rim or base of the shoe upper is provided with perforations 9, while the instep portion of said presents a recess 2.

The heel piece 7 (FIG. 5) of the shoe is applied to the interior of the upper and also the lower rim of said heel piece forms a similar recess correspondingly to its instep portion. These two recesses are complementary to the convex part of the arch support which is to be incorporated into the shoe.

The cover strip 3 (FIG. 2) of the shoe is applied by its upper margin 15 to the unperforate part of the upper base. That part of said upper margin which will be applied to the recess of the upper forms a curve which is complementary to the recess 2.

The insole 11 of the shoe is shown in FIG. 3. The margin of its front part 8 also carries perforations 9, which serve to hand sew this part 8 to the perforate front portion of the upper base 1. The middle part 12 and the rear part 4 of the insole, together with the upper margin of the cover strip 3, are machine sewn by the Sol or California process to the unperforate part of the shoe upper base 1. Being sewn to the base and therefore forced to follow its contour, the middle part 12 of the insole will become arched inward correspondingly to the instep.

The arch support 5 shown in FIG. 4 is preferably of plastic material. It has the usual upwardly arched or convex part 13 to support the foot arch. It is applied under the insole with said convex part positioned under the arched portion of the insole and with its peripheral groove 6 registering with the unperforate portion of the base of upper 1.

The above described components of the shoe are assembled in the following manner:

In a first step, after the completion of the upper by the application of the backstay 10 and the heel piece 7 to it, the cover strip 3 and the middle and rear part 4 and 12 of the insole 11 are simultaneously sewn, by the Sol or California process, to the unperforate base portion of the upper 1. In a successive step, the perforate part 8 of the insole 11 is hand sewn to the perforate base part of the upper 1.

The third step consists in the lasting of the assembled components, the last presenting a cavity correspondingly to the instep area over which the inwardly curved middle portion 12 of the insole will come to lie (FIG. 7). The fourth step consists in the cementing of the arch support upon the external surface of the insole, with the convex or raised part 13 of the arch support applied to the concave part 12 of the insole and the groove 6 of said arch support registering with the contour of the unperforate part of the base.

Finally the cover strip 3 is folded back to cover the arch support from view, and the shoe is completed with the sole 16 and the heel 17 in the usual manner, the sole thus being attached partly to the insole and partly to the arch support.

What is claimed is:

1. A children's shoe incorporating an arch support, comprising:

an upper having a base provided with a perforate front portion and an unperforate middle and rear portion, the instep side of said middle portion having a recess;

a heel piece applied to the upper, the instep side of its rim following the contour of said recess;

a cover strip applied by its top margin to the unperforate portion of said base, part of said top margin forming a curve complementary to said recessed base and being fastened to it;

an insole having a perforate front portion fastened to the front portion of said upper and an unperforate front portion fastened to said unperforate base portion;

an arch support fastened beneath the middle and rear insole portion, said arch support having its raised part fastened to the underside of the instep portion of said insole and a peripheral groove registering with the remaining imperforate base of the upper; and a sole applied over said front portion of the insole and over the arch support.

* * * * *